United States Patent [19]

Leflaive et al.

[11] Patent Number: 4,645,381

[45] Date of Patent: Feb. 24, 1987

[54] BUILDING MATERIAL, ITS APPLICATION FOR EMBANKMENT, SURFACING, OR AS FOUNDATION MASS OVER A LOOSE GROUND, AND METHOD AND INSTALLATION FOR THE PRODUCTION OF SAID MATERIAL

[76] Inventors: Etienne Leflaive, 17 rue M. Voisin, 92330 Sceaux; Claude Guignard, Sercy, 01630 St Genis Pauilley, both of France

[21] Appl. No.: 784,656

[22] Filed: Oct. 4, 1985

Related U.S. Application Data

[63] Continuation-in-part of Ser. No. 132,310, Mar. 19, 1980, abandoned.

[51] Int. Cl.[4] ..... E02D 3/00

[52] U.S. Cl. ..... 405/258; 404/27; 404/70; 405/229

[58] Field of Search ..... 405/15, 16, 17, 24, 405/32, 50, 229, 239, 258; 404/17, 27, 31, 70

[56] References Cited

U.S. PATENT DOCUMENTS

| | | | |
|---|---|---|---|
| 1,841,594 | 1/1932 | Dysart | 405/32 |
| 1,888,364 | 11/1932 | Van Orman | 405/32 |
| 2,731,066 | 1/1956 | Hogendobler et al. | |
| 2,789,399 | 4/1957 | Finn | 405/258 X |
| 2,842,897 | 7/1958 | Finn | 405/258 X |
| 3,299,640 | 1/1967 | Nielsen | 405/24 |
| 3,803,852 | 4/1974 | Fernandez-Luque et al. | 405/24 X |
| 3,934,421 | 1/1976 | Daimler | 405/16 |

FOREIGN PATENT DOCUMENTS

| | | |
|---|---|---|
| 421448 | 3/1972 | Australia . |
| 699511 | 12/1967 | Belgium . |
| 136470 | 10/1917 | Canada . |
| 889669 | 1/1972 | Canada . |
| 961282 | 1/1975 | Canada . |
| 1005653 | 2/1977 | Canada . |
| 29488 | 6/1884 | Fed. Rep. of Germany . |
| 2633613 | 2/1978 | Fed. Rep. of Germany . |
| 2228042 | 11/1974 | France . |
| 953651 | 3/1964 | United Kingdom . |
| 1415524 | 11/1975 | United Kingdom . |

*Primary Examiner*—David H. Corbin

*Attorney, Agent, or Firm*—Mason, Fenwick & Lawrence

[57] ABSTRACT

The present invention relates to a building material and to its application in particular for embankments, surfacings, or mass foundation over loose ground.

Said material comprises at least one flexible continuous element distributed tri-dimensionally in random manner in a mass of solid particles (such as sand) so as to contribute to creating a certain cohesion between the different parts of the mass of particles by entwining these parts.

The invention finds an application in the production of road surfacings or as foundation mass over a loose ground.

9 Claims, 6 Drawing Figures

BUILDING MATERIAL, ITS APPLICATION FOR EMBANKMENT, SURFACING, OR AS FOUNDATION MASS OVER A LOOSE GROUND, AND METHOD AND INSTALLATION FOR THE PRODUCTION OF SAID MATERIAL

This application is a continuation-in-part of application Ser. No. 132,310, filed Mar. 19, 1980 and now abandoned.

The present invention relates to a building material composed of solid particles of compact form such as sand, gravel, stones, pieces of rocks, etc. . . .

The invention also relates to the application of this material to the construction of embankments, road or ground surfacings or as foundation masses over a loose ground.

The invention further relates to a method and installation for producing this material.

The known materials used in buidling works and in civil engineering in particular, are composed of particles of varying sizes bonded together by means of a binder such as cement mortar, bitumen, resin, etc. Ordinary concrete and bitumen concrete are examples of such materials. The particles constituting this family of materials can be of any nature.

The properties of these materials can be altered either by selecting the particles, or by altering the quantity and/or the quality of the binder. It is noted from experiments that high resistances are obtained in that family of materials when using a graded distribution of the constituent particles such that the visible density of the resulting material is close enough to the average density of the particles proper and by using a quantity of binder such that it fills most of the empty spaces left by the assembling of the particles. This result is explained by the fact that both these conditions contribute to increasing the contact surface between the binder and the particles and consequently the number of bonds existing between the latter, which condition is necessary for the composition to have a good mechanical strength.

A first consequence of this is that, with a mass of particles of which the graded distribution is such that the most compact arrangement that can be obtained with these particles comprises a high proportion of empty spaces, a large quantity of binder is necessary, which can become expensive or give a physical performance too close to that of the binder proper, or else give rise to difficulties in the practical preparation of the mixture. This explains how a number of available unbonded materials, whether they are natural or the result of human activities (such as industrial wastes or by-products) are unsuitable for a number of uses in the form of bonded materials because of their inadequate graded distribution.

A second consequence is that a material of high resistance, because it comprises few empty spaces, will have a poor permeability; this being a disadvantage in some applications.

The small proportion of empty spaces, necessarily associated to the increased mechanical strength which can be obtained with specific components, can have other consequences which are bad in same applications: excessive rigidity, high heat conductivity, high voluminal mass, etc.

Moreover, the said known materials—constituted of particles and binder—need to be produced by mixing and kneading the two components, this at least having two main consequences:

the binder, when mixed, should be in such a physical state as to allow the mixing: liquid or pasty form, or powder form, etc. The materials suitable in principle as binders cannot all come in these particular forms, because of the physical limits (such as temperature) imposed by the particles which need to be bound;

the physical state in which the binder should be to allow the mixing can lead to physical and mechanical characteristics of the binder in the final material that are far removed from the maximal characteristics that it could show had it been used in other conditions. Indeed, a lot of materials need, in order to improve their potential mechanical properties, thermal or mechanical treatments (cold-hammering, drawing, laminating, extruding, etc. . . . ) which cannot be applied to a binder either before mixing because such mixing would no longer be possible, or after mixing because then it is no longer accessible within the mixture.

A method is also known for giving a better mechanical performance to a mass of ground. This process consists in incorporating to the soil, elements which withstand well to pulling forces and constitute reinforcements, in electroplated steel, aluminium alloy or in chromium-containing stainless steel. Said reinforcements are in the form of tapes, 120 mm wide or of grids, etc. . . . Owing to these reinforcements, the particles of soil are joined together by the soil-reinforcements contact. The material reinforced according to this technique show the qualities of a powdered material and a strength which is directly proportional to the tensile strength of the reinforcements.

The incorporation of these reinforcing elements to grounds can only be effected on the utilization site. The successive layers of ground should be levelled, then the reinforcing elements have to be suitably arranged on the surface of each layer. This work requires much handling and should be effected with enough accuracy if one wants to obtain a regular distribution and a specific proportion of elements of reinforcement.

In addition, the metallic tapes are relatively expensive, all the more so that they need to be made of corrosion-resisting metals. The ageing factor with such metals also has to be considered.

This reinforced ground is not therefore very widely used because of its price and of the experienced labour required for its production on the actual site, since it is not transportable.

The object of the present invention is to overcome these disadvantages and to propose a material with a good mechanical strength and able to be produced by a simple and reasonably cheap method.

This object is reached according to the invention due to the fact that the material comprises at least one continuous linear element which is flexible—or supple—and distributed tri-dimensionally, in substantially even manner, in a mass of solid particles of compact form, so that it contributes to creating a certain cohesion between the different parts of the mass of particles, although there is no bonding between the particles, between the particles and the linear element, nor between the contacting portions of the linear element to each other.

Advantageously, its content, by weight, of particles is greater than that of the continuous element, said content by weight of continuous element being preferably varying between several hundredths and several tenths.

Advantageously, the continuous element is selected from the following elements: yarn comprising at least one continuous chemical strand, textile yarn formed from discontinuous fibers, wire, metal tape, narrow band, fibrillate blade.

Advantageously, the continuous element constitutes the only binding means between the particles.

Advantageously, the particles are selected from the following types of particles: sand, gravel, stones, pieces of natural rocks, fragments of natural soils, artificial aggregates, concrete blocks, solid domestic or industrial wastes.

The material according to the invention is advantageously produced according to the following method whereby a flow of fluid is created and a mass of solid particles of concentrated—or compact—form are introduced into said flow together with at least one flexible—or supple—continuous linear element, then the particles and the continuous element are mixed together homogeneously and collected on a support and separated from the fluid.

Advantageously, the said flow of fluid is a flow of liquid which liquid is removed when the constituents of the said mixture are collected on the support.

Said method is advantageously performed in an installation which, according to the invention, comprises means for creating a flow of fluid, means for supplying the said continuous element, means for bringing the said element into the said flow of fluid, means for gradually mixing up the said fluid, the said continuous element and a certain proportion of the said means of particles, and means for removing the fluid from the said mixture.

The invention will be more readily understood on reading the following description of several embodiments with reference to the accompanying drawings, in which.

Figures 1, 2:
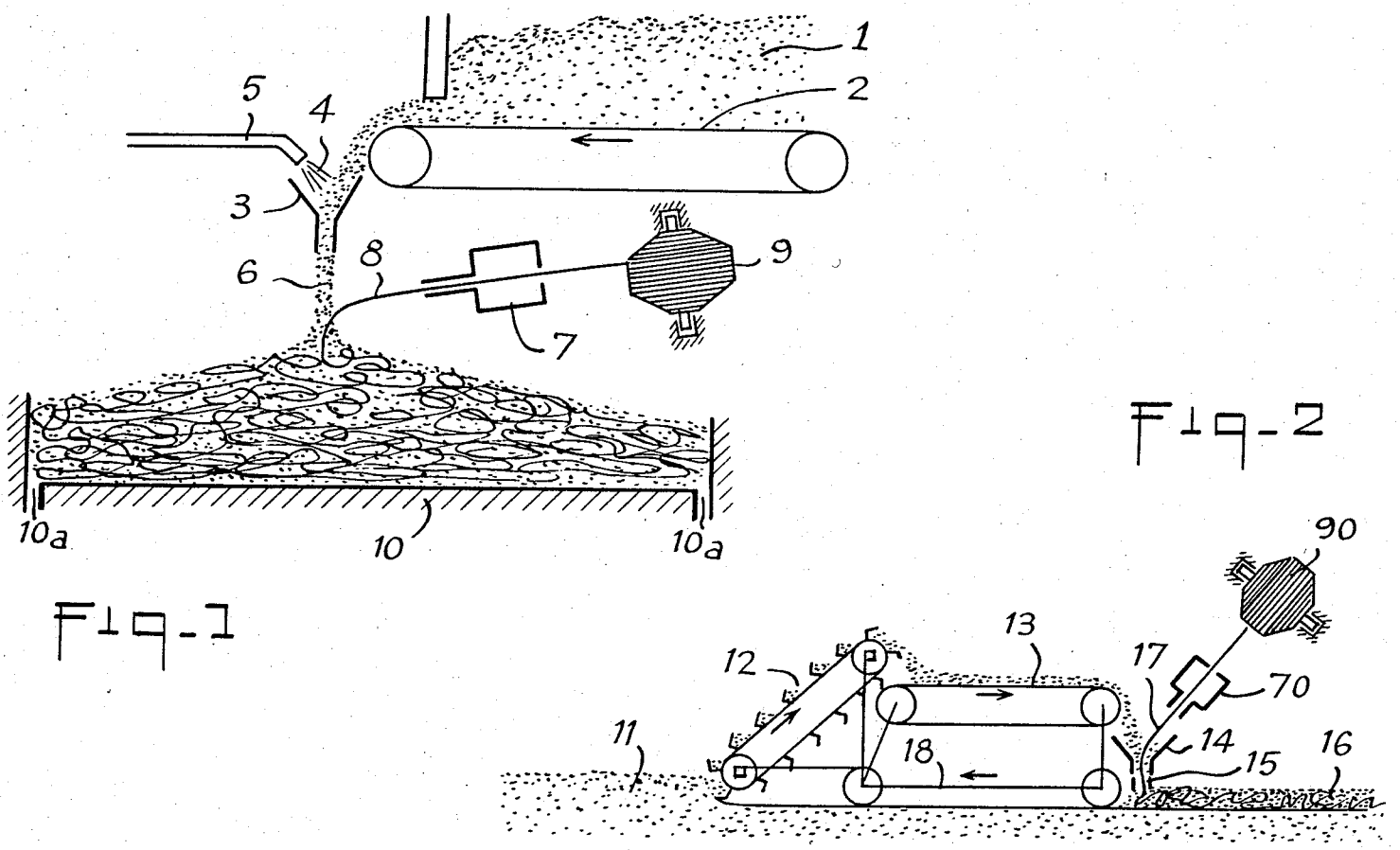
FIG. 1 is a diagrammatical elevation of a first embodiment of an installation for producing the material according to the invention.
FIG. 2 is a diagrammatical elevation of a second embodiment of an installation for producing the material according to the invention.

Thus, the material according to the invention is constituted of a substantially even mixture of particles of concentrated—or compact—form and of wires or yarns, or continuous flexible tapes and/or their combinations.

Advantageously the particles are rigid.

Advantageously, the particles constitute the largest part of the material in weight proportion. Particles of a different nature or origin may be added to the material. Amongst suitable ones, can be cited:

natural mineral particles such as sand, gravel, stones, pieces of natural rocks, fine soils, etc. . . . ;

natural mineral particles, treated (by crushing, surface treatments, etc. . . . ) and/or selected by screening, sifting, sedimentation or any other selecting means, forming a mixture of controlled grading composition and the properties (shape, surface characteristics, etc. . . . ) whose particles have been improved;

reconstituted mineral particles: concrete blocks, artificial aggregate composed of sand and slack bonded together with a binder, artificial mineral aggregate of all natures such as expanded clay, expanded schist, etc. . . . , which particles come from the grinding, by any method, of a concrete or of any other type of bonded material such as gravel or sand cement gravel or sand bitumen, gravel or slag sand, etc. . . . ;

particles, whether mineral or not, of industrial origin.

The grading of the particles constituting the material may be extremely varied, both in maximum or average sizes of the particles and in the graded distribution, depending on the intended object and/or on the conditions of production.

The wires, yarns, small laminae (or small bands) or fibrillate strips which constitute the main component of the material object of the invention are continuous elements. Within the scope of the invention, the term "continuous" should be interpreted in the way it is normally interpreted in the textile industry, namely that the elements used are of great length with respect to fibers of natural origin (whose length is normally only a few centimeters), or with respect to cut chemical fibers such as those are used in industry.

The above-mentioned continuous wires, yarns, tapes, small bands can be produced immediately before being mixed with the particles, or they can be produced industrially and re-used for the mixing under an appropriate form (reels, skeins, etc. . . . ).

The nature of the wires, yarns, tapes or small bands used in the material needs to be such that their mechanical properties are good enough for the final material to give a good mechanical performance.

In the case of yarns, the nature of the fibers or strands forming part of them can be varied: animal or vegetable natural fibers, chemical and/or metallic filament of fibers.

The yarns, small bands or fibrillate laminae can be of chemical and/or metallic nature.

All the continuous wires, yarns, tapes, small bands and fibrillate laminae and their combinations, will be designated hereinafter as continuous elements.

The proportion by weight of continuous elements in the material can advantageously vary between a low rate value percent and a very low rate value per tenthousandth for example.

Different parameters can be used to describe the material, such as for example:

parameters describing all the particles (nature, mechanical properties, dimensions, shape, grading distribution, parameters describing the geometrical disposition, etc. . . . ).

parameters describing the continuous elements (nature, transverse dimensions, mechanical properties, etc. . . . );

parameters describing the relations inside the material between the mass of particles and the network—or assembly—of continuous elements, and in particular amongst these:

the volumeral and weight percentages of the continuous elements, with respect to the particles, the average length L of the continuous elements per unit of volume of the material, the dimension M of the average theoretical cubical mesh which would correspond to a tri-dimensional cubical network of the same value L, the geometrical distribution of the continuous elements inside the material, parameters describing the overall performance of the material in relation to the uses made of it.

The material obtained according to the invention is constituted by the imbrication of a mass of particles and a tri-dimensional network of continuous elements.

The said continous elements are distributed—or disposed—in disorder inside the mass of particles; each section—or part—of said continuous elements is randomly orientated and arranged in the space, the distribution of said sections being dependent on the conditions of production and use.

The essential part played by the continuous elements with respect to the mass of particles, is two-fold It is:

1. To contribute to the mechanical strength of the mixture. The mechanical interaction of the network of continous elements and of the mass of particles is complex. The continuous elements are stretched, when deformations occur in the mass of particles, by different mechanisms, amongst which: the friction between the continuous elements and the particles, the tensioning under the effect of the friction, of the incurved portions of the path lines of the continuous elements, the limitation of the possibilities for the continuous elements to move within the mass of particles by the criss-crossing of said elements.

The absence of bonding between the particles and the continuous elements and between the elements themselves, permits the relative local displacement of the components in the more highly stressed points and leads to an homogenizing of the forces within the material as the deformations spread. This mechanism enables the resistance of all the continuous elements of one zone to cumulate, and thus to use to a maximum the overall resisting capacity of the continuous elements. This would be impossible if there was bonding (or adhesion) of the continuous elements to the particles and/or together, because the local stress concentrations would lead to premature local failure of the more highly stressed points before the adjacent continuous elements are substantially tensioned. This reaction, permitted by the possibility of localized adjustment at the start of the tensioning of the material, is particularly remarkable and advantageous in practice, when the material is subjected to rapid stresses: shocks, rough applications of pressure, dynamic forces, seismic effects. What is then obtained is a non-delicate reaction, which contributes to the static safety of the structures and to the absorption of energy in cases of dynamic stresses.

The great length of the continuous elements plays an important part in these mechanisms since the accumulation of the tangential friction forces between continous elements and particles has to be achieved over a sufficient length to reach a value approaching or equal to the tensile strength of the continuous elements, thus mobilizing all their resisting capacity. The bonding between particles and continuous elements being only the result of friction, the incurved shape of the path line of these elements, them: when they go around the particles and contact therewith, multiplies the tractive force in the continuous element according to an exponential function of the change of direction angle of the continuous element. Moreover, the length of the continuous elements allows the transmission, by said elements of the forces inside the material, to great distances with respect to the diameter of the particles.

2. To improve the resistance to internal or external erosion of the mass of particles, following the imbrication of the particles inside the network of continuous elements, in particular with respect to erosion due to water running or infiltrating. The resistance to erosion will improve all the more that the ratio of M to the average dimension of the particles is small.

The material obtained according to the invention shows a number of basic properties which, for many applications, have considerable advantages compared with currently available materials.

1. The material constituting the continuous elements (wires, yarns, tapes, small bands and their combinations) is used in a form which is much more efficient, for equal quantity, than a bulk binder, to resist the pulling forces occurring inside the mass of particles subjected to stresses. The continuous elements can indeed be produced by an industrial process capable of developing the potential mechanical properties of the material composing them; for example they can be subjected to a controlled drawing suitable for obtaining optimum mechanical properties, such as tensile strength for example.

2. The use of the material constituting the continuous elements in the form of wires, yarns, tapes, small bands, or fibrillate strips and/or their combination permits an efficient transmission of the forces inside the material whilst occupying only a very small fraction of the empty spaces in the granular mass. This gives a number of great advantages, for example:

(a) it is possible to use a much lower proportion by weight or volume of the material constituting the continuous elements with respect to the whole material than in the case of a bulk binder, to obtain the same mechanical result;

(b) it is possible to obtain a material of quality with a mass of particles of so-called hollow or discontinuous grading, —i.e. of a grading allowing a very high proportion of empty spaces—, whereas such a result is very difficult to obtain with a bulk binder without correcting the grading. This advantage is especially important to improve the available material of which the grading is unsuitable for treatments with a bulk binder;

(c) since the empty spaces in the mass of particles are not filled with a mortar or a binder, it is possible to obtain a material with altogether a high permeability, a good mechanical resistance and a good resistance to erosion; this result is particularly advantageous for many applications in which the hydraulic conductivity of the material is a factor of major importance;

(d) since the empty spaces in the mass of particles are not filled with mortar, it is possible to obtain a material which has both a low heat conductivity and good mechanical resistance;

(e) for the same reason, it is possible to obtain a material with a low density and a good mechanical strength.

3. From a mechanical standpoint, it is possible to produce materials which are both strong and of controllable deformability by a judicious selection of the material constituting the continuous elements, of the proportion of the continuous elements used in the mass of particles and their geometrical distribution therein. Now, it is important, when planning a work, to be able to choose materials of required deformability, neither too low nor too high, in order to solve the problems of distribution of stresses between different elements of a product or between the ground and the product. The materials bonded with bulk binders are often either excessively rigid or prone to creeping.

4. The stresses inside the material according to the invention are divided and transmitted in two complementary and more or less independent ways occurring respectively in each of two dimensional ranges of the material: these stresses are transmitted on the one hand, from one particle to another inside the mass of particle, on the other hand, through the network of continuous elements. The complementary nature of these two transmission modes affords a compensation of the local heterogeneities and, as a result, a better overall mechanical homogeneity; for example, a localized weakness (compressibility, fragility, etc. . . . ) of one or more particles will not constitute a defect which can be at the origin of a breaking process.

The conditions in which a material has been produced are given hereunder, by way of example:

particle: sand of grading 0.2 to 2 mm;

continuous element: untwisted yarn of 17 tex formed by 46 strands of polyester;

percentage by weight of yarn with respect to the sand: 0.14 per cent;

L =0.125 m/cm3;

M =4.9 mm.

The yarn is incorporated to the sand as follows (see FIG. 1):

the sand 1 is brought in at a controlled rate by an endless belt 2;

the sand 1 falls into the hopper 3 where it is carried away with water sprayed in 4 by a nozzle or spreader jet 5;

under the hopper 3, a constant flow of water and sand 6 is created, the form and speed of which are controlled;

a pneumatic delivery gun 7 projects, towards the flow 6 a yarn 8 which comes from a reel 9;

the yarn/sand dosage is thus controlled by the control of the flow of sand and the speed of projection of the yarn 8;

the sand+yarn+water mixture settles on a support 10, in layers successively covering one another progressively with the flow, whilst the water is drained naturally by gravity for example towards the outlets 10*a* of the support 10.

The material produced this way has a dry density of about 1.5 g/cm3. Placed in a container of low rigidity (PVC) and subjected, at that density, to a punching test using a circular punch of 50 mm diameter, the force needed for driving in punches of 1 mm is approximately 1 ton, this corresponding to approximately 50 kg/cm2, pressure without common measure with the punching pressure of the same sand containing no yarns and placed at the same density.

The material according to the invention finds a special application in building and civil engineering (including agricultural engineering, etc. . . . ).

Amongst possible applications for the material according to the invention, the following one is given by way of example and non-restrictively. This application is illustrated in FIG. 2 and consists in the inexpensive production of a road on a sandy ground, unsuited, in its natural state, to receive vehicles. The work is effected on a natural ground composed of clean sand of grading: 0.2 to 1 mm when dry.

A superficial layer 11 of the sand of the laidout track is removed by means of a loading excavator 12 which supplies a conveyor belt 13; said latter, which is situated in parallel to the lay-out of the track, is meant to drop the sand back on the track lay-out via a hydraulic cyclone—or hopper 14—. The form and rate of the flow of sand and water 15 permit to resettle the sand regularly over the track lay-out. Whilst the sand is dropping on to the ground, yarns 17, supplied from a reel 90, are projected pneumatically by a device 70 on to the sand and is incorporated therein. These yarns are polyester yarns of 40 decitex, in the proportion of 0.1% by weight of the sand.

In view of the width of the machine which is 2 meters, the operation is repeated over several parallel channels the number of which is dependent on the width proposed for the track. Another solution consists in producing the material in a specific place and in transporting and spreading it.

The assembly of layers 16 deposited on the ground, is then compacted.

In the aforesaid application, the equivalent theoretical cubic mesh M has a value of 2.1 mm and the length of the yarn per unit of volume is L =0.68 m/cm3.

A common rolling frame 18, which may be automotive, supports the endless belt 13, the excavator 12 and if necessary the elements 14, 70 and 90.

Another application of the material described hereinabove is the production of a foundation mass for oil drilling works at sea.

A coarse sand of 1 to 3 mm grading is dredged on a suitable site and transported by barges on the working site. Said sand is picked up by hydraulic means and polyamide yarns of 100 decitex are incorporated to the sand by direct hydraulic drive means.

The dosage by weight of the yarns is of 0.2% of the weight of the sand (M=3 mm). The sand+yarns mixture is deposited on the sea bed to progressively constitute a foundation mass which resists erosion during the making up phase and which shows good mechanical properties. A final external protection is given by depositing, using the same method, a coarser divided material, of between 5 and 10 mm grading, the yarns being yarns of 150 decitex, in the proportion by weight of 0.3% by weight of the divided material (M=3 mm).

Other possible applications of the material according to the invention:

superficial layer to protect a sandy area (such as a desertic area) against wind erosion.

light and insulating materials constituted by the material obtained according to the invention wherein the particles are lightweight aggregates (expanded clay for example);

draining and filtering layer for surfacing banks or for coast protection;

mass embankment with a steeper slope than would allow the particles used without continuous elements;

mass embankment resisting to erosion;

surfacing material resisting to erosion;

substratum of a concrete road;

substratum for railway lines.

Figure 3:
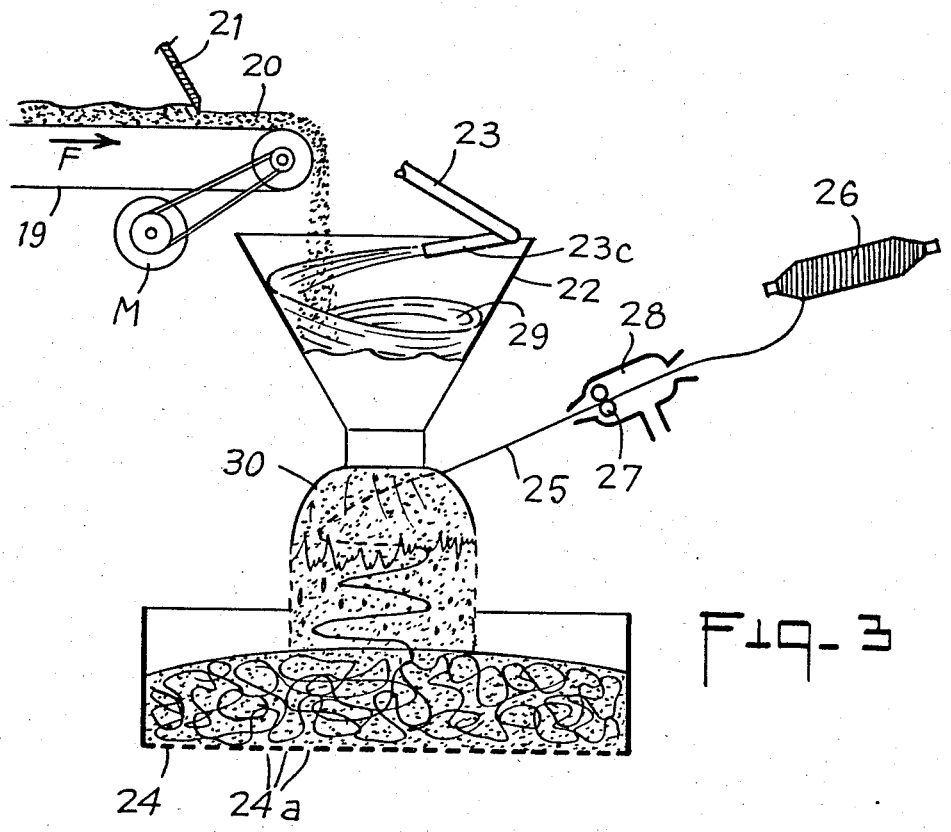
FIG. 3 is a partial diagrammatical elevation of a third embodiment of an installation for producing the material according to the invention.

FIG. 3 shows a conveyor belt 19 supplying the granular material 20, and associated to a flow regulating device constituted by a scraper 21 extending crosswise above the belt 19 at an adjustable distance which is dependent upon the desired rate of flow. Said belt 19 is driven in the direction of arrow F by a motor M. The unloading end of the belt 19 is situated above a hopper 22, cylindro-conical in shape, which is also supplied with water via a pipe 23, the supply end 23*a* of which is helical-shaped so as to communicate a vortex motion to the water distributed by said pipe. The hopper 22 is placed above a receiving surface 24 advantageously constituted by a sieve which is provided to allow the removal of the water from the solid materials.

A device for supplying filiform reinforcement elements, such as for example a textile or plastic yarn 25 of indefinite length is provided on the outside of the hopper. Said supply device comprises a supply reel, a pair of driving rollers 27 for driving the yarn 25 and a compressed air gun 28 for guiding the yarn towards the whirling mixture of sand and water, coming out of the hopper 22.

The method carried out with the installation according to the invention consists in pouring a predetermined quantity of granular material 20 in the hopper 22 inside which hopper is immediately created a vortex of water 29 which mixes with the granular material and carries it in its whirling motion. At the outlet of the hopper 22, the water and the granular material form a tubular flow 30 which, under the effect of tangential force, flares out in descent as a sort of sheet of sludge twirling turbulently. It is in that part of the flow that the yarn is brought by reels 27 which fix the supply of the yarn and by the gun 28 which, in its jet of compressed air, guides the yarn 25 into the mixture of granular material and liquid 30. The liquid takes the yarn into its whirling motion directing it towards the receiving surface 6 where the said yarn mixes with the granular material as the latter settles, whereas the water is evacuated through the holes 24*a* provided in the receiving surface 24. The yarn 25 could, as in the case of FIG. 2, be incorporated to the flow of water and sand in the hopper 22. It is also possible to simultaneously incorporate several yarns, either in one single part, or in different parts of the flow of liquid.

Figure 4:
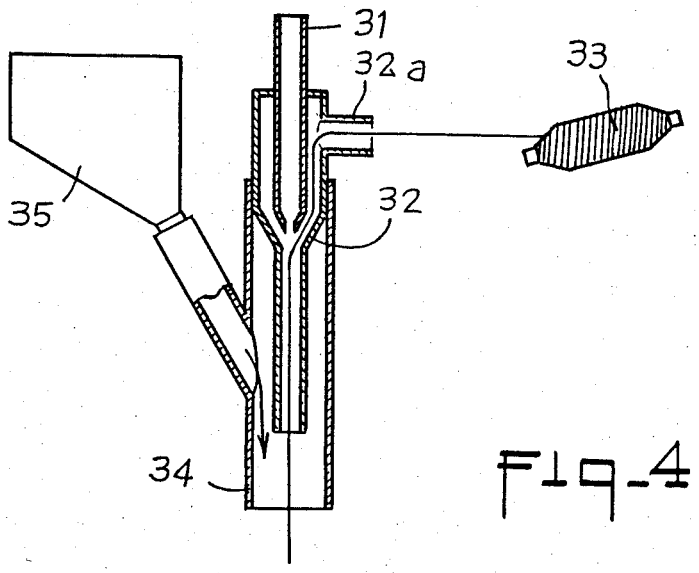
FIG. 4 is a partial diagrammatical elevation of a fourth embodiment of an installation for producing the material according to the invention.

The device shown in FIG. 4 uses a double ejector. Such device comprises a nozzle 31, connected to a source of pressurized water not shown. The nozzle 31 issues into a pipe 32 connected laterally via a pipe 32*a* to a source of filiform element 33. The pipe 32 narrows towards the base and issues into a larger pipe 34 which communicates laterally with a source of sand 35; said latter can be supplied by means similar to those shown in FIG. 1 for example.

The depression created in the pipe 32 at the outlet of the nozzle 31 sucks in the yarn of the reel 33, which yarn is carried with the water through the pipe 32. The depression created in the pipe 34 at the outlet of the pipe 32 sucks in the sand from the source 35. Such a device should work with a dry sand or else, means should be provided to prevent the sand from clogging up between the reserve of sand 35 and the pipe 34.

Figure 5:
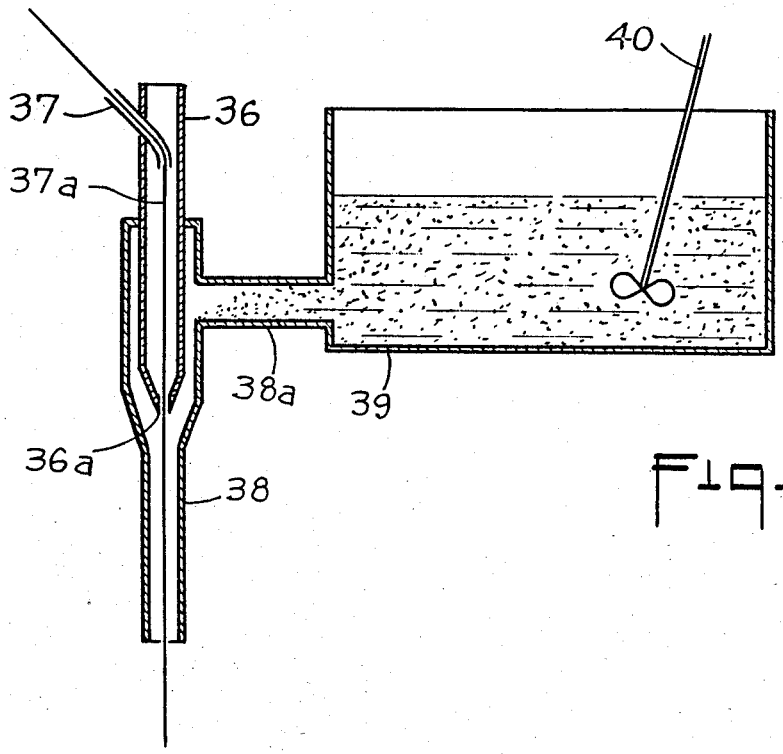
FIG. 5 is a partial diagrammatical elevation of a fifth embodiment of an installation for producing the material according to the invention.

FIG. 5 shows a variant embodiment with one ejector, which comprises a nozzle 36, into which issues a pipe 37 for guiding a yarn 37*a*. Said nozzle 36 issues into a pipe 38 which communicates laterally via a conduit 38*a* with a tank 39 containing a mixture of sand and water stirred by an agitator 40.

The water is brought under pressure into the nozzle 36 and creates a depression at the outlet 36*a* of the nozzle, which depression sucks in the mixture of water and sand of the tank 39 together with the reinforcing yarn 37*a* in order to deposit the said mixture on to a support, not shown, wherefrom the water is drained off.

Figure 6:
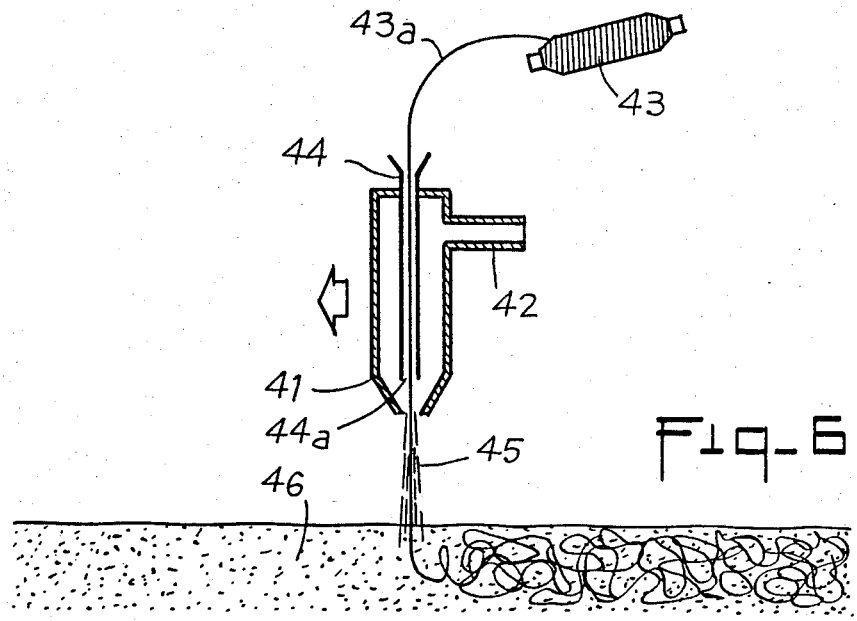
FIG. 6 is a partial diagram of a sixth embodiment of an installation for producing the material according to the invention.

Finally, FIG. 6 shows another variant embodiment comprising one ejector 41 connected to a source of pressurized water via a lateral pipe 42 and to a reel of yarn 43 via a pipe 44. The yarn 43*a* carried by the depression created by the water flow at the level of the outlet 44*a* of the pipe 44, is directed with the spray of water 45 sent by the ejector 41 into a layer of granular material 46. The pressure of the spray of water causes the liquid to penetrate the layer 45 to a certain depth, which depth is dependent upon the pressure and the said liquid carries the yarn into the said layer whilst mixing it with the sand. A relative movement between the spray of water and the layer of sand ensures the distribution of the yarn.

We claim:

1. A building material comprising flexible tridimensional reinforcement means disposed in a mass of solid discrete particles of compact form with the reinforcement means contributing to creating cohesion within and between the different parts of the mass of particles, wherein said reinforcement means comprises at least one very long supple continuous linear element distributed tri-dimensionally, in substantially even manner throughout the volume occupied by said mass of particles, without any bonding between said particles, between said particles and said linear element and between contacting portions of the linear element to each other, said very long supple continuous linear element entwining said parts of said mass of particles so as to provide cohesion of the mass.

2. A material as claimed in claim 1, wherein the continuous particles in the mass of particles are naturally occurring non-manmade particles.

3. A material as claimed in claim 1, wherein the weight of the particle contents of the material is substantially greater than the weight of the long supple continuous linear element content with the weight of said continuous element being between a few hundredths and a few ten thousandths the weight of said particles.

4. A material as claimed in claim 1, wherein the long supple continuous linear element is selected from the following group: a yarn comprising at least one chemical continuous strand, a textile yarn formed from discontinuous fibers, wire, metallic tape, small band, fibrillate strip.

5. A material as claimed in claim 1, wherein the particles are selected from the following: sand, gravel, stones, pieces of natural rocks, fragments of natural soils, artificial aggregates, concrete blocks, industrial and domestic solid wastes.

6. The combination of claim 1, wherein the solid particles comprise sand and the said very long supple continuous element comprises an untwisted polyester yarn.

7. The combination of claim 6, wherein the weight of the yarn is 0.14% of the weight of the sand.

8. The combination of claim 7, wherein there is 0.125 meter yarn for every cubic centimeter of building material.

9. The combination of claim 6, wherein the weight of the yarn is approximately 0.1% of the weight of the sand.

* * * * *